United States Patent [19]

Winter

[11] 4,261,435

[45] Apr. 14, 1981

[54] LADDER TRAY

[76] Inventor: Milton Winter, 13206 Challaburton Dr., Dallas, Tex. 75234

[21] Appl. No.: 27,410

[22] Filed: Apr. 5, 1979

[51] Int. Cl.[3] ..... E06C 7/14

[52] U.S. Cl. ..... 182/129; 182/121

[58] Field of Search ..... 182/120, 121, 129, 172; 248/210, 238; D64/18

[56] References Cited

U.S. PATENT DOCUMENTS

| | | | |
|---|---|---|---|
| 2,388,142 | 10/1945 | Harris | 182/61 |
| 2,444,584 | 7/1948 | Touchett | 248/210 |
| 2,997,127 | 8/1961 | Wojtowicz | 182/172 |
| 3,009,677 | 11/1961 | Munnikhuysen | 248/210 |

*Primary Examiner*—Reinaldo P. Machado

*Attorney, Agent, or Firm*—Warren H. Kintzinger

[57] ABSTRACT

A tray with a clip and wire frame support for secure mounting on the top platform of a step ladder. The tray is shaped to hold tools, and with small tray pockets - screws, nails and other small items may be held, and if painting is to be done the ladder tray is sized to hold paint trays of substantially all sizes.

2 Claims, 3 Drawing Figures

LADDER TRAY

Figure 2:
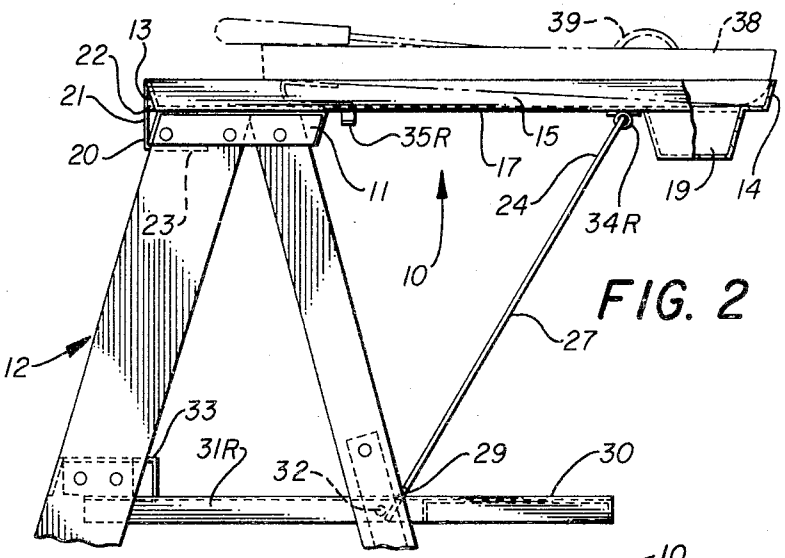

This invention relates in general to work convenience trays, and more particularly, to a work convenience tray adapted for secure mounting on the top platform of a step ladder.

In working from a step ladder it is important to have your hands free to accomplish the desired work, and in working from a small work bench, in the form of a securely mounted tray, reducing trips up and down the ladder and to avoid a balancing act in the process. It would prove helpful to have a work tray securely mounted on the top platform of a step ladder, of whatever size being used, that may be used as a convenience holder for paint trays and also as a ladder tray for repair work, holding tools and in tray pockets screws, nails and/or other small items. The ladder top tray is capable of holding larger paint trays of such size that would not fit between ladder legs on a conventional ladder wood shelf. With work aids conveniently supported and in hand juggling of equipment lessened work hazzards are minimized, work may be accomplished quicker, more accurately and easier with reduced frustration and strain.

It is, therefore, a principal object of this invention to make work from a step ladder easier, safer and more convenient.

Another object is improved work performance through use of a work convenience tray mounted on the top of a step ladder.

A further object with such a convenience tray is to better free the hands for the work being done and lessen the requirement for trips up and down the ladder.

Still another object is for the convenience tray to provide good support for a paint tray used with roller painting from a step ladder.

Features of the invention useful in accomplishing the above objects include, in a convenience tray mounted on the top platform of a step ladder, a tray large enough to receive substantially all roller paint tray sizes. The convenience tray also includes pockets for holding small items such as nuts and bolts, and nails and other small items, and the tray is available for holding hand tools particularly when not in use for holding a roller paint tray. The tray has a surrounding rim, a clamp member at one end that clamps on the top platform of the ladder and a support bracket that extends to supporting bifurcated engagement with support arms of a ladder shelf.

A specific embodiment representing what is presently regarded as the best mode of carrying out the invention is illustrated in the accompanying drawing.

Figure 3:
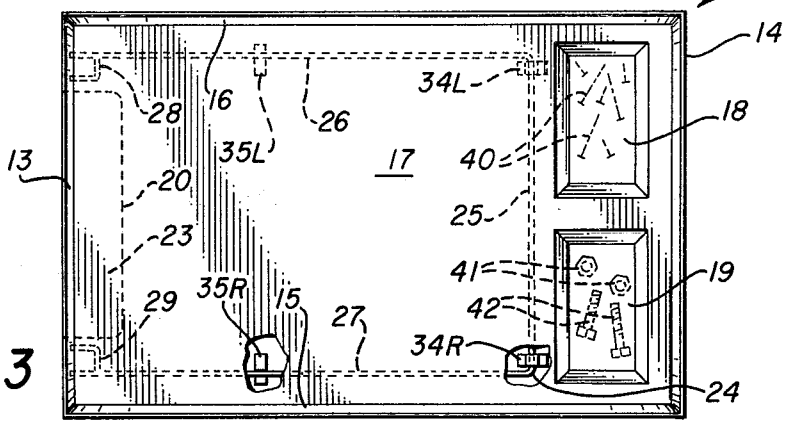
Figure 1:
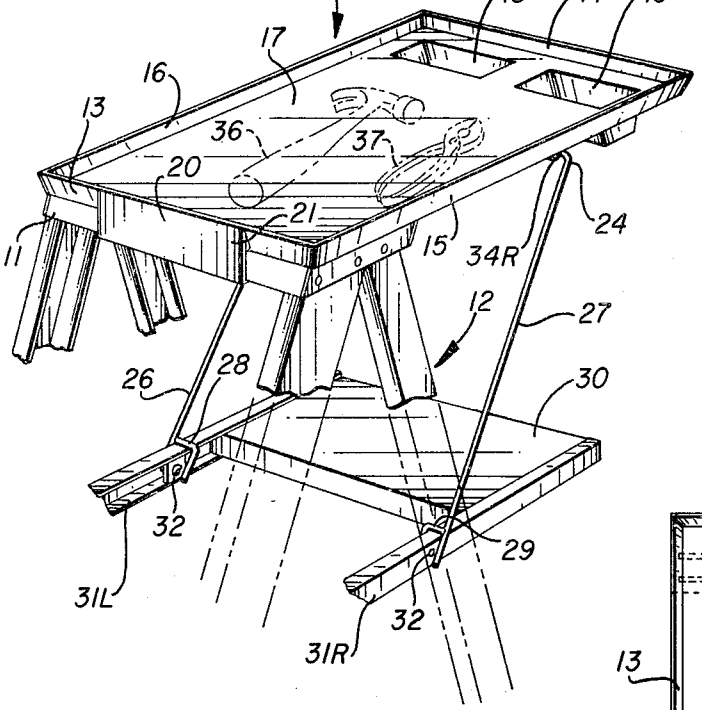

In the drawing:

FIG. 1 represents a partial perspective of a step ladder equipped with a top platform mounted convenience tray;

FIG. 2, a partial side elevation view with the tray mounted in place at the top of the step ladder; and, FIG. 3, a top plan view of the convenience tray of FIGS. 1 and 2.

REFERRING TO THE DRAWING

A convenience tray 10 is shown in FIGS. 1 and 2 to be mounted on the top platform 11 of a step ladder 12 of conventional construction. The tray 10 is formed with end walls 13 and 14 and side walls 15 and 16 extending upward as an enclosure from the tray bottom 17 that is provided with small part holding pockets 18 and 19 formed in the tray bottom 17 to extend therebeneath in the forward end of the tray 10 from the rear end resting on ladder top platform 11. Tray mounting clamp 20 has an upward extension 21 fastened as by weldment 22 to tray wall 13 and is formed with a forward extension 23 that fits under ladder top platform 11 to resiliently clamp hold the tray 10 in place on the top of platform 11. A wire support bracket 24 is formed with a center top transverse portion 25 interconnecting two depending support arms 26 and 27 that terminate at their lower ends in bifurcated support ends 28 and 29 that engage platform 30 support arms 31L abd 31R. The platform 30 and support arms 31L and 31R pivot about their respective pivot pin 32 mountings to a use position with the extended ends of arms 31L and 31R in engagement with the bottom of ladder step 33 in a conventional manner. With platform 30 and support arms 31L and 31R in the use position shown in FIGS. 1 and 2 the bifurcated ends 28 and 29 of support bracket 24 grip arms 31L and 31R, respectively, on the platform 30 side of the pivot pin 32 mountings. The arm bifurcated ends 28 and 29 and the bracket grip arms are put in position as shown with lifting of the forward wall 14 end of tray 10 upward with a resilient deflection of tray mounting clamp 20 sufficient to do so. Then the tray 10 is securely held in place with the bracket 24 with support arms 26 and 27 angled as they are effectively, in addition to tray 10 support, holding the tray 10 fully forward and clamp 20 in full clamping state on ladder top platform 11.

With further reference also to FIG. 3, the wire support bracket 24 is shown to be pivotally mounted to the bottom of tray bottom 17 just immediately to the rear of part holding pockets 18 and 19 by pivot mountings 34L and 34R. This pivot mounting provides that the bracket 24 may be pivoted from a retracted state as retained by clamps 35L and 35R, as shown in FIG. 3, to the support state of FIGS. 1 and 2. Insertion of the bracket legs 26 and 27 in clamp 35L and 35R is accomplished by resilient deflection of the legs for insertion into and removal from the clamps 35L and 35R.

Thus, there is hereby provided a securely mountable convenience tray 10 for step ladders 12 that is useful for holding tools such as the hammer 36 and pliers 37 shown in phantom in FIG. 1. A paint tray 38 with paint roller 39 is shown in phantom in FIG. 2 where convenience tray walls limit movement of the paint tray 28 as a great convenience aid in roller painting from the step ladder 12. Nails 40 are shown to be held in small part holding pocket 18 and nuts 41 and bolts 42 are shown in pocket 19 in FIG. 3 as a user convenience in working from the step ladder 12.

Whereas this invention has been described with respect to a single embodiment thereof, it should be realized that various changes may be made without departing from the essential contributions to the art made by the teachings hereof.

I claim:

1. In a convenience tray constructed for mounting on the top of a step ladder: a tray body having a bottom and wall means extending upwardly from the bottom to present a wall surrounded equipment holder tray resting on the top platform of a step ladder the tray is mounted on and extending outwardly to the rear of the ladder in an overhang type relation; clamp means fastened to the rear end of said tray body extending to beneath the step ladder top platform; bracket support means mounted on the underside of the bottom of said tray body and angled downward and back to fastened engagement with step ladder support means for combined tray support and retention of said clamp means with the rear end of said tray body on said step ladder top platform; wherein said clamp means is a resiliently deflectable clamp that clamps the tray body to the top of the step ladder top platform; said support means has arm means extending from mounting of the support means to bifurcated connection end means for connection with said step ladder support means; said arm means is two opposite side arms with said bifurcated connection end means a bifurcated connection mounting end on each of said two opposite side arms that are interconnected through a transversely extended tray bottom mounted portion; said bracket support means is in the form of a round wire rod formed to the two opposite side arms with the interconnect portion therebetween and formed with said bifurcated ends at opposite ends; pivot mount means is fastened to said tray body and pivotally mounts said bracket support means; said clamp means is resiliently deflectable sufficiently for putting arm bifurcated ends in tray supporting fastened engagement with step ladder support means; said bracket support means is pivotal between a use tray support position and a retracted position; clamp means holding said bracket support means arms in the retracted position; and with said bracket support means arms resiliently deflectable for insertion into said clamp means in the retracted position and removal therefrom for pivoting of said bracket support means to the tray mount support position; and wherein downward depending small part holding pocket means is formed in said bottom of said tray body extending to below the general plane of the tray bottom and to below the level of the top of the top platform the tray is mounted on.

2. The step ladder convenience tray of claim 1 wherein said pocket means is formed toward the forwardly outwardly extended end portion of said tray body bottom; and with the pivotal mounting of said bracket support means located adjacent said pocket means toward the clamp means end side of said tray body.

* * * * *